United States Patent [19]

Holzer

[11] Patent Number: 4,987,038

[45] Date of Patent: Jan. 22, 1991

[54] FINE GOLD ARTICLES

[76] Inventor: Walter Holzer, Dristeweg 19, Meersburg, Fed. Rep. of Germany, 7758

[21] Appl. No.: 417,631

[22] Filed: Oct. 5, 1989

[51] Int. Cl.[5] ..... B32B 15/01

[52] U.S. Cl. ..... 428/672; 428/687; 63/2

[58] Field of Search ..... 428/672, 687; 63/2, 63/15

[56] References Cited

FOREIGN PATENT DOCUMENTS 24692 8/1979 Japan ..... 427/383.9

*Primary Examiner*—Melvyn J. Andrews
*Assistant Examiner*—George Wyszomierski
*Attorney, Agent, or Firm*—Brown, Martin, Haller & McClain

[57] ABSTRACT

Structurally strong, investment quality gold articles of high troy weight, excellent color and revealing properties and the method of their production are described, including the formation of a structural base from an alloy containing not over 8% of a strengthening material such as chromium, titanium or vanadium, which can provide the required strength and hardness in low concentrations, and overlayment or "overaching" with a gold alloy coating in a manner such that both alloys are visible. The structural base provides the support, strength and resistance to corrosion in articles of various shapes, while retaining a high degree of gold fineness.

6 Claims, 1 Drawing Sheet

FINE GOLD ARTICLES

BACKGROUND OF THE INVENTION

1. Field of The Invention

This invention relates to the manufacture of hitherto nonexistent beautiful, investment quality gold articles and adornments of extremely high purity, yet capable of being worn and otherwise used.

2. Description of the Prior Art

Known and highly valued from the earliest times, gold is the most malleable and ductile metal. One ounce can be pounded to provide 300 sq. ft. of gold leaf with which to adorn large pieces of artwork or architecture or drawn into 60 miles of wire.

It is well known that gold has to be alloyed for strength. Steel and other metal objects can be gold plated, but as an investment, these objects are worthless. Gold alloys are used to produce wearable gold articles. Sometimes gold alloys are laminated to produce a beautiful piece of jewelry of a desired grade of fineness on its outer shell, but containing a filler of much lower value.

Burdon, U.S. Pat. No. 440,693, describes a method of manufacturing seamless compound gold wire which can be molded into articles of jewelry and sold as gold of a specified value or carat. This value represents the average of the higher content gold shell and the lower content internal filler. Articles produced by Burdon's method still suffer from low purity and lack of uniformity when considering jewelry as an investment, averaging around 9 carats. Furthermore, the consumer is not readily able to ascertain the gold content of the entire piece, and abuses have been common.

Fry, U.S. Pat. No. 1,704,126, describes a process whereby a thin layer of platinum is laminated to a surface of gold alloy stock which comprises a softer inner gold-copper alloy layer, which is workable with jeweler's tools, and a gold-nickel outer layer, which possesses good color. To achieve a 14 carat average value for the gold stock, Fry uses a thick inner layer of 13.5 karat fineness gold-copper alloy, and a thin layer of 20 karat fineness gold-nickel. To obtain a 14 karat fineness average value, Fry does little more than plate the core with the finer alloy, the ratio being approximately 21:1. While the outer coating prevents tarnishing and imparts a beautiful color, the concept still does not relate to producing quality gold jewelry.

What is needed is a method of producing gold articles which have the luxurious appearance and extreme fineness of nearly pure gold, and the strength to be wearable or otherwise useable. To be of investment quality, such articles must also be readily appraisable. If only it were possible to construct durable articles of nearly solid gold. The present disclosure presents a solution. Described herein is a method of manufacturing beautiful, investment quality, wearable and otherwise useable gold articles with a hitherto unavailable troy weight of 22 karat fineness or more.

SUMMARY OF THE INVENTION

This invention is an article of structurally strong, investment quality gold articles of high troy weight, excellent color and revealing properties, comprising: an investment quality gold alloy base of at least 22 karat fineness comprising gold alloyed with at least one additional element which is present in sufficient concentration to impart strength to said alloy but not to exceed 8% of this alloy; and a gold alloy coating also of at least 22 karat fineness surrounding and affixed to all but one side of said base; the relative proportions of said base and said coating being readily discernible from the uncoated portion of the base.

Also part of this invention is a method of producing gold articles of investment quality, comprising the steps of: producing a gold alloy of at least 22 karat fineness and comprising gold alloyed with another element which enhances the strength of said alloy, said element being present in an amount sufficient, up to 8% of said alloy, to enhance said strength; overlaying said base on all but one side with a coating of a second gold alloy of at least 22 karat fineness and bonding said base and said coating to form a uniform article, the relative proportion of said base and said coating readily determined by examining the uncoated part of said base.

In a method of producing articles from gold alloys, this invention provides an improvement whereby investment quality articles of 22 karat fineness or more are produced by the steps comprising constructing a base of 22 or more karat fineness comprising gold alloyed with another element which enhances the strength of said alloy, each element being present in an amount sufficient, up to 8% of said alloy, to enhance said strength; and overlaying said skeleton on all sides but one with a gold alloy coating of 22 or more karat fineness, the base and coating being readily visible from the uncoated side.

Thus, gold jewelry and other articles are produced where the structural base layer is not hidden but incorporated into an attractive and informative pattern, yielding something like a cross-sectional perspective. Other embodiments of the present invention need not specifically require that the coating alloy cover all sides readily visible without examination. For example, the structural base and the coating can be disposed relative to each other in a manner to take advantage of the beauty of the colors imparted by each of them.

Although chromium, titanium and vanadium have been discovered nearly two hundred years ago or more, and have been used in alloys with other metals, to the Applicant's knowledge, they have not been alloyed with gold to produce articles described here. These elements have the specific properties of strength and hardness required in the structural base in such low concentrations.

DETAILED DESCRIPTION OF THE INVENTION

Figure 1:
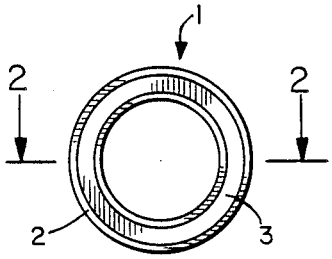
FIG. 1 is a schematic representation of an article of this invention, namely a ring, formed of the bonded gold alloys.
Figure 2:
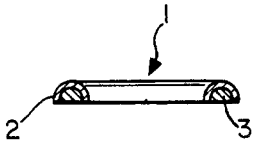
FIG. 2 is a sectional view along line II-II of FIG. 1.

Referring more particularly to the drawings, FIGS. 1 and 2 schematically illustrate the concept of this invention. FIG. 1 depicts the outside surface of a ring, displaying a uniform, fine structured gold alloy. FIG. 2, however, shows that the ring is not of a uniform character, but is in fact composed of a core or base 3 and an overlying abutting noncontinuous coating layer 2. The core or base, which serves as a structural support member, comprises an alloy having at least two elemental components, one component of which is a hard metal added for the specific purpose of strengthening the entire structure. The other component is pure 24 karat fineness gold.

It is critical to this invention that the coating layer coats or clads more than half, and preferably most surfaces of all sides except the back, of the jewelry article, so that the coating "arches over" and is fully supported by the base layer. The idea here is not to use the core as a filler with an inferior gold alloy, as is practiced in the prior art, but to use a strengthener which is effective in small amounts in order to maintain a high quality 22+ karat fineness structure throughout the article while yet providing a high strength alloy base to support the outer coating layer. In order to retain the near-pure gold composition, the strengthener must be present and effective in concentrations of or below 8%. If the alloy is other than binary, the concentration of strengthener must be adjusted to compensate.

The unclad surface of the jewelry article need not always be hidden from view or on the underside. In an alternate embodiment, if the two alloys are of different colors, this structural aspect can be exploited to produce jewelry in variant attractive color patterns, keeping in mind the purpose of the unclad side so as not to distort consumer perception.

The use of pure gold as an overwhelmingly major component of an alloy teaches away from having to choose inferior metals for their workability properties resulting in low quality jewelry. Being the most malleable and ductile metal, gold can tame the hardness and brittleness of the added strengthener, and does not have to be replaced by copper or some other previously used metal for these workability properties.

Figure 3:
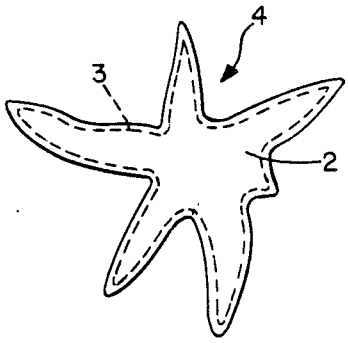
FIG. 3 is a top plan view of an article of this invention namely a brooch, produced according to the method of this invention.

FIG. 3 is a top plan view of a gold brooch 4 constructed in the manner defined by this invention. The uniform outer coating 2 covers an underlying supporting structural base 3. As stated above, it is envisioned that in another embodiment the layers could be combined in a manner where the base structural layer is not covered by the coating layer, but where the two layers are exposed, for example, in a banded arrangement, if the effect were aesthetically pleasing. In other words, the supporting structural base could be revealed by positioning it to be visible, e.g. topmost, while retaining its supportive function. In all cases the thickness of the overlying coating preferably is uniform.

The two layers constituting the gold jewelry can be joined or bonded in any conventional manner known and practiced by those skilled in the art, including "sweating" or welding, cementing or merely sheathing if appropriate.

It will be appreciated that, regardless of the proportions of the two alloys, the overall value or carat rating is 22 karat fineness or more, since both alloys are high quality, 22 karat fineness or better, and the rating for the jewelry article is not attained by averaging a low rated filler and a high rated thin shell as commonly found in the prior art.

I claim:

1. A structurally strong, investment quality gold article of high troy weight, excellent color and visible structural properties, comprising:

a. a strengthened gold alloy structural base of at least 22 karat fineness gold and at least one other element added for strength;

b. a gold alloy coating of at least 22 karat fineness surrounding and affixed to all but one side of said structural base; and c. relative proportions of said structural base and coating alloys being readily discernible by viewing an area containing an uncoated portion of said structural base.

2. An article as described in claim 1 wherein said strengthened gold alloy comprising said structural base contains a strengthening element selected from the group consisting of chromium, vanadium and titanium.

3. An article as described in claim 1 wherein said gold alloy coating contains an element imparting a color to said coating.

4. An article as described in claim 3 wherein said strengthened gold alloy possesses a color different from said color of said gold alloy coating.

5. An article as described in claim 1 wherein said element added for strength is present in a concentration not greater than 8%.

6. An article as described in claim 1 wherein said coating is non-contiguous.

* * * * *